US005171654A

United States Patent [19]

Yamazaki et al.

[11] Patent Number: 5,171,654

[45] Date of Patent: Dec. 15, 1992

[54] TONERS FOR DEVELOPING ELECTROSTATIC IMAGES

[75] Inventors: Hiroshi Yamazaki, Hachioji; Yuki Okuyama, Sagamihara; Yoshiaki Koizumi, Hachioji; Isao Endou, Kawasaki; Satoru Ikeuchi, Hino, all of Japan

[73] Assignee: Konica Corporation, Tokyo, Japan

[21] Appl. No.: 746,721

[22] Filed: Aug. 19, 1991

[30] Foreign Application Priority Data

Aug. 21, 1990 [JP] Japan ..... 2-219837

[51] Int. Cl.[5] ..... G03G 9/087; G03G 9/097

[52] U.S. Cl. ..... 430/110; 430/111; 430/137

[58] Field of Search ..... 430/110, 111, 137

[56] References Cited

U.S. PATENT DOCUMENTS 4,839,255 6/1989 Hyosu et al. ..... 430/137
5,085,963 2/1992 Suzuki et al. ..... 430/111 X

FOREIGN PATENT DOCUMENTS 238843 11/1985 Japan ..... 430/137
246073 10/1987 Japan ..... 430/137
1-93749 4/1989 Japan .
234858 9/1989 Japan ..... 430/111

*Primary Examiner*—Roland Martin
*Attorney, Agent, or Firm*—Finnegan, Henderson, Farabow, Garrett and Dunner

[57] ABSTRACT

A toner for electrostatic image developing is disclosed. It is prepared by giving a mechanical impact force to radically polymerized particles containing a colorant and a low molecular weight polyolefine so as to have the low molecular weight polyolefine exist at a ratio of 5 to 40% by number on a surface of the particles. The toner has a uniform and good electrification property, high fixability and no offsetting property.

13 Claims, No Drawings

TONERS FOR DEVELOPING ELECTROSTATIC IMAGES

The present invention relates to a toner used in developing electrostatic images, particularly to the constitution of toner particles.

Preparation of a toner by the polymerization method is known in the art. In the polymerization method, a toner is generally prepared by suspending a material to form the toner in water and forming particles by suspension polymerization. On the other hand, there is disclosed in Japanese Patent O.P.I. Publication No. 153944/1980 that use of low molecular weight polyolefins is effective in improving the fixability of a toner prepared by the pulverization method. Following this instance, there has been tried addition of low molecular weight polyolefins to a toner prepared by the polymerization method for the purpose of improving fixability. But, as described in Japanese Patent O.P.I. Publication No. 230664/1985, low molecular weight polyolefins can hardly contribute to the improvement of fixability, because they are generally liable to be buried inside of a polymer composition and cannot be present at the surface of polyolefin particles for their low surface energy and hydrophilicity. Under such circumstances, various studies are being made to solve this problem.

For example, Japanese Patent O.P.I. Publication Nos. 230644/1985 and 238843/1985 disclose attempts to have these low molecular weight polyolefins present at the particle surface by adding hydrophilic polyolefins in order to enhance the compatibility with water. However, this has a drawback to impair the electrification property in a high temperature and high humidity environment, since the surface of polyolefin particles turns to hydrophilicity with the addition to hydrophilic polyolefins.

Further, Japanese Patent O.P.I. Publication No. 93749/1989 describes an attempt to aggregate particles by steps of adding and dispersing low molecular weight polyolefins in a polymerization system to associate them with emulsion-polymerized particles, and then giving a mechanical impact force to the particles formed through association. However, these low molecular weight polyolefins cannot be dispersed so finely as emulsion-polymerized particles; therefore, it is difficult to have them exist uniformly in toner particles.

As stated above, use of polyolefins has been proposed in many ways as a means to improve the electrification property, fixability and anti-environmental property of toners prepared by the polymerization method, but none of them are satisfactory.

SUMMARY OF THE INVENTION

The object of the present invention is to provide a toner for an electrophotographic developer prepared by the polymerization method and containing a polyolefin and a colorant, which has a uniform and good electrification property, high fixability and no offsetting property.

The toner of the invention is a toner for electrostatic image developing, prepared by steps of suspending a radically polymerizable monomer, low molecular weight polyolefin, colorant and radical polymerization initiator in a suspending medium, allowing the suspended matter to undergo radical polymerization, and then giving a mechanical impact force to the colored and polymerized particles having a volume-average particle size of 3 to 12 μm in order to have the low molecular weight polyolefin exist at a ratio of 5 to 40% by number on the surface of the colored particles.

In the invention, the low molecular weight polyolefin existing "at the surface" means that said polyolefin is present in a surface layer up to a depth of 0.1 μm.

A mechanical impact force, repetitively given to colored particles containing a low molecular weight polyolefin prepared by the polymerization method, grinds the surface of the colored particles and allows the low molecular weight polyolefin to come out to the particle surface.

It is preferable that the radical-polymerizable monomer be selected so as to give a polymer having a softening point of 100° to 200° C. and glass transition point of 50° to 70° C. The weight-average molecular weight of the polymer to be prepared is preferably $5\times10^4$ to $1\times10^6$; the number-average molecular weight of the polymer is preferably $1\times10^3$ to $1\times10^5$.

Preferred examples of the radical-polymerizable monomer used in the invention include styrene monomers such as styrene, o-methylstyrene, m-methylstyrene, p-methylstyrene, α-methylstyrene, p-ethylstyrene, 2,4-dimethylstyrene, p-butylstyrene, p-t-butylstyrene, p-hexylstyrene, p-octylstyrene, p-nonylstyrene, p-decylstyrene, p-dodecylstyrene, p-methoxystyrene, p-phenylstyrene, p-chlorostyrene and 3,4-dichlorostyrene. Other examples include olefins such as ethylene, propylene, butylene, isobutylene; vinyl halides such as vinyl chloride, vinylidene chloride, vinyl bromide, vinyl fluoride; vinyl esters such as vinyl acetate, vinyl propionate, vinyl benzoate, vinyl butyrate; α-methylene aliphatic monocarboxylates such as ethyl acrylate, butyl acrylate, isobutyl acrylate, propyl acrylate, octyl acrylate, dodecyl acrylate, lauryl acrylate, 2-ethylhexyl acrylate, stearyl acrylate, 2-chloroethyl acrylate, phenyl acrylate, methyl-α-chloroacrylate, methyl methacrylate, ethyl methacrylate, propyl methacrylate, butyl methacrylate, isobutyl methacrylate, octyl methacrylate, dodecyl methacrylate, lauryl methacrylate, 2-ethylhexyl methacrylate, stearyl methacrylate, phenyl methacrylate, dimethylaminoethyl methacrylate, diethylaminoethyl methacrylate; derivatives of acrylic acid or methacrylic acid such as acrylonitrile, methacrylonitrile, acrylamide; vinyl ethers such as vinylmethyl ether, vinylethyl ether, vinylisobutyl ether; vinylketones such as vinylmethyl ketone, vinylheyl ketone, methylisopropenyl ketone;N-vinyl compounds such as N-vinylpyrrole, N-vinylcarbazole, N-vinylindole, N-vinylpyrrolidone; and vinyl naphthalenes. These monomers may be used singly or in combination of two or more to give a copolymer.

In polymerizing these monomers, a radical polymerization initiator is generally used in an amount ranging from 0.1 to 10% by weight of monomer. An appropriate addition amount is determined by a final polymerization degree.

Typical examples of the polymerization initiator include peroxide type initiators such as acetylcyclohexylsulfonyl peroxide, isodibutyl peroxide, diisopropylperoxydicarbonate, di-2-ethylhexylperoxydicarbonate, 2,4-dichlorobenzoyl peroxide, t-butylperoxypivalate, 3,5,5-trimethylhexanoyl peroxide, octanoyl peroxide, decanoyl peroxide, lauroyl peroxide, stearoyl peroxide, propionyl peroxide, succinic acid peroxide, acetyl peroxide, t-butyl peroxy-2-ethylhexanoate, benzoyl peroxide, p-chlorobenzoyl peroxide, t-butyl peroxyisobutylate, t-butylperoxymaleic acid, t-butylperoxylaurate, cyclohexanone peroxide, t-butyl peroxyisopropylcarbonate, 2,5-dimethyl-2,5-dibenzoyl peroxyhexane, t-butylperoxyacetate, t-butyl peroxybenzoate, diisobutyl diperoxyphthalate, methyl ethyl ketone peroxide, dicumyl peroxide, 2,5-dimethyl-2,5-di-t-butyl peroxyhexane, t-butylcumyl peroxide, t-butyl hydroperoxide, di-t-butyl peroxide, 2,5-dimethyl-2,5-di-t-butyl peroxyhexane, diisopropylbenzene hydroperoxide, p-methane hydroperoxide, pinane hydroperoxide, 2,5-dimetylhexane-2,5-dihydroperoxide, cumene hydroperoxide; and azo type initiators such as 2,2'-azobisisobutyronitrile, 1,1'-azobis(cyclohexane-1-carbonitrile), 2,2'-azobis-4-methoxy-2,4-dimethylvaleronitrile, 2,2'-azobis-2,4-dimethylvaleronitrile.

A crosslinking agent may be used in the polymerization system to obtain a crosslinked polymer. Preferred crosslinking agents are those compounds which have two or more polymerizable double bonds. Examples thereof include diethylenic carboxylates such as ethylene glycol dimethacrylate, diethylene glycol dimethacrylate, triethylene glycol dimethacrylate, trimethylolpropane triacrylate, allyl methacrylate, tetraethylene glycol dimethacrylate, 1,3-butane diol dimethacrylate; divinyl compounds such as N,N-divinyl aniline, divinyl ether, divinyl benzene, divinyl sulfide, divinyl sulfone; and compounds having three or more vinyl groups. These may be used singly or in combination.

The addition amount of such crosslinking agents to a monomer is generally 0.005 to 20% by weight, preferably 0.1 to 5% by weight. An excessive addition amount raises the softening point and eventually loses the fixability. When the addition amount is too small, toner properties such as durability, preservability and abrasion resistance can be hardly imparted, particularly an anti-offsetting property in the fixing process is lowered when used in hot roll fixing type copying machines.

Suspension polymerization is carried out by suspending a polymerization composition, through mechanical stirring, in a suspension medium such as water as fine particles of desired sizes. Suspension stabilizers are used to prevent association of suspended particles, since the suspended particles come to be cohesive and associate with one another to form large particles as the polymerization proceeds.

Water is used as a suspension medium, and an organic solvent such as methanol may be further added according to a specific requirement.

Compounds used as a suspension stabilizer are generally classified into two main groups, namely water-soluble polymeric substances and sparingly soluble inorganic compounds. The former includes gelatin, starch, polyvinyl alcohol, etc. The latter includes sparingly soluble salts such as barium sulfate, calcium sulfate, barium carbonate, calcium carbonate and calcium phosphate; combinations of the sparingly soluble salts and surfactants such as sodium dodecylbenzene sulfonate and sodium dodecyl sulfate; inorganic polymeric metal oxides such as talc, clay, silicic acid and diatomaceous earth; and other powders. When a polymerization composition contains an ionic substance (for example, a cationic substance such as nitrogen-containing polymerizable monomer or sparingly water-soluble amine, or an anionic substance) and thereby its suspended particles in water are charged with either of negative and positive polarities, an ionic dispersant which disperses in water with a polarity opposite to that of suspended polymer particles can be effectively utilized as a suspension stabilizer. Examples thereof include negatively electrifiable colloidal silica and positively electrifiable aluminum oxide.

The low molecular weight polyolefin may be a homopolymer obtained from a single kind of olefin monomer or a copolymer obtained by copolymerization of an olefin monomer and another copolymerizable monomer.

Examples of the olefine monomer include ethylene, propylene, butene-1, pentene-1, hexene-1, heptene-1, octene-1, nonene-1, decene-1; their isomers different in positions of unsaturated bond; olefins having a branched chain consisting of alkyl group such as 3-methyl-1-butene, 3-methyl-2-pentene, 3-propyl-5-methyl-2-hexene; all other olefins. Of them, ethylene and propylene are particularly preferred.

Other monomers copolymerizable with an olefin monomer include, besides other olefine monomers, vinyl ethers, vinyl esters, halogenated olefins, acrylates, methacrylates, acrylic acid derivatives and organic acids such as itaconic acid.

Further, there may be also used a modified polyolefin which is blocked or grafted with another component.

It is preferable that such a polyolefin have a weight-average molecular weight of 6,000 to 70,000 and a number-average molecular weight of 1,500 to 20,000.

Next, examples of preferable polyolefins used in the invention are shown; namely, Viscol 330-P, Viscol 550-P, Viscol 660-P (polypropylenes made by Sanyo Chemical), 320 P, Hiwax 310 P, Hiwax 410 P, Hiwax 405 P, Highwax 400 P, Hiwax 200 P (polyethylenes made by Mitsui Petrochemical), Sanwax 131-P, Sanwax 151-P, Sanwax 161-P, Sanwax 165-P, Sanwax 171-P (polyethylenes made by Sanyo Chemical), Polywax 400, Polywax 500, Polywax OH-465, Polywax 1040 (polyethylenes made by Toyo Petrolite).

These polyolefins may be used singly or in combination. The addition amount of these polyolefins is preferably 1 to 10% by weight and especially 2 to 7% by weight of polymerizable monomer.

As a colorant, there may be used magnetite, carbon black, Niglosin dye (C.I. No.50415B), aniline blue (C.I. No.50405), Calco oil blue (C.I. No. azoic Blue 3), chrome yellow (C.I. No.14090), ultramarine blue (C.I. No.77103), Du pont Oil Red (C.I. No.26105), quinoline yellow (C.I. No.47005), methylene blue chloride (C.I. No.52015), phthalocyanine blue (C.I. No.74160), malachite green oxalate (C.I. No.42000), lamp black (C.I. No.77266), rose Bengal (C.I. No.45435), and mixtures thereof. These colorants have to be used at a concentration sufficient to form visual images of adequate density; its addition amount is generally 1 to 20% by weight of a binder resin obtained by the radical polymerization. The toner of the invention may contain additives such as a UV absorbent and fluorescence dye according to a specific requirement.

The colored particles according to the invention can be prepared by steps of adding a prescribed amount of a colorant, low molecular weight polyolefin, polymerization initiator and other additives to a polymerizable monomer, mixing them thoroughly to form a uniformly dispersed polymerization composition with a stirrer such as sand stirrer, adding it to a water-based suspension medium containing a suspension stabilizer, dispersing the polymerization composition into oil droplets having a particle size appropriate for toner, and then allowing the polymerization composition dispersed into fine oil droplets in the suspension medium to polymerize. Colored particles consisting of a colorant and polyolefin fine particles are thus obtained. Since the size of these colored particles is determined by the dispersing state of the polymerization composition, the colored particles can be polymerized to a necessary size, namely a volume-average particle size of 3 to 12 μm, by adjusting dispersing conditions. Consequently, after the resulting colored particles are separated from the suspension medium, they can be subjected to a mechanical impact treatment as they are.

As a surface-treating apparatus which exerts a mechanical impact force to have the necessary amount of a low molecular weight polyolefin existing at the surface of the colored particles obtained as above, a freemill, hybridizer (product of Nara Kikai Seisakusho), Angmill (product of Hosokawa Micron) and Kryptron (product of Kawasaki Heavy Ind.) can be used.

As a treating intensity in a system having high-speed rotation blades like a hybridizer, for example, it is preferable that the peripheral speed of such blades be about 50 to 100 m/sec. A low peripheral speed does not produce a noticeable grinding effect, and thereby the amount of a low molecular weight polyolefin existing at the surface cannot increase adequately; a high peripheral speed tends to exert an excessive mechanical energy, and thereby the toner itself is crushed up to yield fine particles.

The surface treatment may be carried out at the normal temperature or under heating. But it is preferable that the temperature of colored particles determined by the following method be 50° to 110° C. and lower than the glass transition point of said colored particles.

The temperature of colored particles mentioned here means an average of approximate surface temperatures of the colored particles obtained by inserting a temperature measuring probe into a stream of particles flowing under the application of impact force so as to have the particles contact the probe at random.

The temperature measuring probe is composed of a thermocouple, temperature measuring resistor, etc. And temperatures can be determined by measuring electrically its electromotive force, resistance value, etc.

A typical example of the thermocouple is a chromel-alumel thermocoupler.

In the invention, the temperature of colored particles is measured with a chromel-alumel thermocoupler covered with a stainless steel (SUS 304) shield having a length of 10 cm and a diameter of 6.4 mm (product of Hayashi Denko). Measurement is carried out by inserting its head by 5 cm.

In the invention, the quantity of a low molecular weight polyolefin existing at the surface can be measured by the ESCA. Measuring conditions of the ESCA are shown below. The definition of percentage by number is also described below.

Measuring apparatus: PHI Model 560 ESCA/SAM made by Perkin-Elmer Co.

Measuring conditions: X-ray output = 15 kV, 26.7 mA

Sample preparation: particles are scattered on a strip of double coated adhesive tape, then the strip is fastened on a sample stand.

Quantitative calculation is carried out from peak areas of respective elements, using peaks of carbon = Cls, oxygen = Ols, and nitrogen = Nls.

Since the sensitivity varies by elements, area intensities obtained by measurement are subjected to sensitivity correction according to "Handbook of X-ray Photoelectron Spectroscopy" prepared by Perkin-Elmer Co. Using intensity ratios obtained in this way, the percentage by number is determined from the ratio of elements existing at the particle surface and the ratio of elements of a material used. That is, since the ratio of elements existing at the surface is determined by the ratio of used materials existing at the surface, the existing quantities can be determined by solving the following simultaneous equations.

$$k = xa1 + xb1 + xc1$$

$$l = ya2 + yb2 + yc2$$

$$m = za3 + zb3 + zc3$$

where x, y, z show existing amounts (%) of constituent compounds A, B and C, respectively; a1, a2 and a3 show a ratio of elements 1, 2 and 3 which constitute compound A; b1, b2 and b3 show a ratio of elements 1, 2 and 3 which constitute compound B; c1, c2 and c3 show a ratio of elements 1, 2 and 3 which constitute compound C; and k, l and m represent a ratio of particle-constituting elements 1, 2 and 3. In the invention, x, y and z are respectively defined as percentages by number of constituent compounds A, B and C.

As an apparatus for the ESCA, there may be used ones other than the above apparatus. Examples of such include Shimadzu's ESCA-1000 and JEOL's JPS-90SX.

When the colored particles are prepared by polymerization, a low molecular weight polyolefin is scarcely present at the surface of the colored particles. Said polyolefin comes out to the surface of the colored particles only when a mechanical impact force is given to the particles. In other words, the low molecular weight polyolefin exists uniformly in the colored particles, and when the surface of the particles are ground by a mechanical impact force, the low molecular weight polyolefin comes out to the surface. Therefore, the quantity of the low molecular weight polyolefin existing at the surface can be controlled by varying the mechanical impact force as described above.

When the quantity of the low molecular weight polyolefin existing at the surface is more than 40% by number, frictional electrification between toner particles increases, thereby the transfer ratio comes to be lowered, and moreover, the anti-environmental dependency is deteriorated. On the contrary, when the quantity of the low molecular weight polyolefin existing at the surface is less than 5% by number, the fixing property is lowered and the offsetting property is eventually deteriorated.

The toner of the invention may contain a magnetic material, charge controlling agent and dispersant according to a specific requirement.

As magnetic materials, there may be used ferromagnetic metals such as iron, cobalt, nickel, and their alloys and compounds containing these elements such as ferrite, magnetite; alloys which contain no ferromagnetic materials but come to be ferromagnetic when subjected to a proper heat treatment, examples of which include Heusler's alloys containing copper and manganese such as manganese-copper-aluminum alloy and manganese-copper-tin alloy; and chromium dioxide and others.

EXAMPLES

The present invention is hereunder described in detail with the examples. In the following description, "part"

means a relative weight in the same weight unit, unless otherwise specified.

Particle preparation 1

| | |
|---|---|
| Styrene | 80 parts |
| Butyl acrylate | 20 parts |
| S-34 (product of Orient Chemical) | 1 part |
| Viscol 660-P (polypropylene made by Sanyo Chemical) | 3 parts |

The above compounds were mixed and then heated to 80° C. under stirring to dissolve Viscol 660-P. After cooling it to room temperature,

| | |
|---|---|
| Azobisisobutyronitrile | 1 part |
| Mogul L (carbon black) | 5 parts |

the above compounds were mixed therein and dispersed with a sand grinder rotating at 2,000 rpm to obtain a polymerization composition. Subsequently, the polymerization composition was added to a concentration of 20% by weight to a water containing colloidal tricalcium phosphate in an amount of 3% by weight of the polymerization composition and sodium dodecylbenzene sulfonate in an amount of 0.04% by weight of the polymerization composition. Then, a high speed shearing force (about 8,000 rpm) was applied thereto with a TK homo-jetter so as to disperse the polymerization composition in the water into particles of about 10 μm size, so that a suspension of the polymerization composition was obtained. The particle size was determined by microscopic observation. Next, the suspension was allowed to polymerize for 8 hours at 65° C. under stirring, in a flask equipped with a cooling tube, thermometer and nitrogen-gas-introducing tube. After completion of polymerization, hydrochloric acid was added to remove the colloidal tricalcium phosphate used as a suspension stabilizer, and the polymerization product was further washed with water. Colored particles having an average particle size of 10.1 μm were thus obtained. These colored particles are referred to as polymerized particle 1. Then, 130 g of polymerized particle 1 was subjected to surface grinding with a hybridizer model 1 (product of Nara Kikai Seisakusho) by applying a mechanical impact force for 3 minutes at a peripheral speed of 75 m/sec and at a particle temperature of approximately 45° C. The particles obtained had an average particle size of 10.0 μm. These particles are referred to as treated particle 1. Polymerized particle 1 and treated particle 1 were subjected to measurement by the ESCA to determine the quantity of polypropylene existing at the surface. The measuring conditions were as follows:

Measuring apparatus: PHI Model 560 ESCA/SAM made by Perkin-Elmer Co.

Measuring conditions: X-ray output = 15 kV, 26.7 mA

Sample preparation: particles are scattered on a strip of double coated adhesive tape, then the strip is fastened on a sample stand.

Sensitivity correction: "Handbook of X-ray Photoelectron Spectroscopy" prepared by Perkin-Elmer Co.

The quantities of polypropylene existing at the surfaces were calculated from the measured results. The calculation results were 1% by number for polymerized particle 1 and 28% by number for treated particle 1.

Particle preparation 2

Treated particles having an average particle size of 10.0 μm were prepared in the same manner as in particle preparation 1, except that treating conditions were changed to a peripheral speed of 100 m/sec, a particle temperature of approximately 50° C. and a treating time of 3 minutes. These treated particles are referred to as treated particle 2. The quantity of polypropylene existing at the surface of treated particle 2 was 35% by number.

Particle preparation 3

Treated particles having an average particle size of 10.1 μm were prepared in the same manner as in particle preparation 1, except that treating conditions were changed to a peripheral speed of 60 m/sec, a particle temperature of approximately 50° C. and a treating time of 3 minutes. These treated particles are referred to as treated particle 3. The quantity of polypropylene existing at the surface of treated particle 3 was 20% by number.

Particle preparation 4

Colored particles having an average particle size of 10.6 μm were prepared in the same manner as in particle preparation 1, except that the polymerization was carried out at 75° C. using 1 part of lauryl peroxide instead of azobisisobutyronitrile, 6 parts of Viscol 660-P, 60 parts of EPT-1000 (product of Toda Kogyo) instead of Mogul L, and 0.1 part of lecithin. These colored particles are referred to as polymerized particle 2. Treated particles having an average particle size of 10.4 μm were prepared by giving a mechanical impact force to polymerized particle 2 in the same manner as in particle preparation 1. These treated particles are referred to as treated particle 4. The quantity of polypropylene existing at the surface of treated particle 3 was 35% by number. The quantities of polypropylene existing at the surface were calculated as in particle preparation 1; the results were 1% by number for polymerized particle 2 and 25% by number for treated particle 4.

Particle preparation 5

Treated particles having an average particle size of 10.5 μm were prepared in the same manner as in particle preparation 4, except that conditions of the mechanical impact force were changed to those in particle preparation 2. These treated particles are referred to as treated particle 5. The quantity of polypropylene existing at the surface of treated particle 5 was 38% by number.

Particle preparation 6

Treated particles having an average particle size of 10.5 μm were prepared in the same manner as in particle preparation 4, except that conditions of the mechanical impact force were changed to those in particle preparation 3. These treated particles are referred to as treated particle 6. The quantity of polypropylene existing at the surface of treated particle 6 was 18% by number.

Toner and developer preparation

Electrophotographic properties were evaluated using the above treated particles. In the evaluation, toners 1, 2 and 3 were prepared by adding 0.5% each of hydrophobic silica R-972 to treated particles 1, 2 and 3, and treating the particles for 10 minutes with a tabular mixer. Toners 4, 5 and 6 were prepared by adding 0.4% each of hydrophobic silica R-972 to treated particles 4, 5 and 6, and treating the particles for 10 minutes with a tabular mixer. Further, comparative toner 1 was prepared by adding 0.5% of silica R-972 to polymerized particle 1 and treating particle for 10 minutes with a tabular mixer. Comparative toner 2 was prepared by adding 0.4% of silica R-972 to polymerized particle 2 and treating the particle for 10 minutes with a tabular mixer.

Further, toners 1, 2 and 3 and comparative toner 1 were respectively mixed with an iron powder carrier (approximately 100 μm) surface-coated with a styrene-acrylic resin to prepare developers having a toner concentration of 3%.

Evaluation of electrophotographic properties (1) Electrification quantity: The iron powder carrier was added to each of toners 1 to 6 and comparative toners 1 and 2, and electrification quantity in a high temperature and high humidity environment was evaluated on each toner by the blowoff method. Ratings corresponding to shaking times with the iron powder are shown in the table below.

Evaluation results of electrification quantity

| Sample | 1-minute shaking | 10-minute shaking | 30-minute shaking |
|---|---|---|---|
| Toner 1 | −17.1 μc/g | −16.7 μc/g | −15.9 μc/g |
| Toner 2 | −18.3 μc/g | −17.8 μc/g | −16.8 μc/g |
| Toner 3 | −16.1 μc/g | −15.7 μc/g | −14.9 μc/g |
| Toner 4 | −25.3 μc/g | −24.5 μc/g | −24.1 μc/g |
| Toner 5 | −23.9 μc/g | −22.7 μc/g | −22.0 μc/g |
| Toner 6 | −24.5 μc/g | −23.8 μc/g | −22.9 μc/g |
| Comparative toner 1 | −18.5 μc/g | −13.5 μc/g | −11.5 μc/g |
| Comparative toner 2 | −23.7 μc/g | −21.5 μc/g | −18.3 μc/g |

(2) To evaluate the fixability, the winding property and offsetting property were examined. In examining these properties, the U-Bix 1550 (product of Konica Corp.) was used to form images respectively containing toners 1, 2, 3 LP-3015 was used to form images respectively containing toners 4, 5, 6 and comparative toner 2.

Winding property

Using a transferred image (unfixed) having a solid black head, the winding property was evaluated by determining a temperature at which a transfer paper began to wind around a fixing roller (winding temperature) while the set temperature of the fixing roller was changed 5° C. at a time from 230° C. As the fixing apparatus, a fixing unit of the U-Bix 1550 (product of Konica Corp.) was modified and used. The surface layers of the fixing roller and pressing roller were respectively formed from Teflon-silicone rubber KE-1300R-TV. The passing speed of the transfer material was 120 mm/sec, and no silicone oil was fed to the surface of the fixing roller.

Offsetting property

Using the fixing apparatus mentioned above, fixing was carried out by passing a transfer paper carrying an unfixed toner image at a linear speed of 120 mm/sec and then passing a blank transfer paper at the same condition, while the set temperature was raised by 5° C. in stages. While the fixing was carried on as stated above, whether a toner stain occurs or not was visually checked, and the lowest temperature which caused a roller stain was taken as an offset generation temperature.

The results of the above evaluations are shown in the table below.

| Sample | Winding temperature | Offset generation temperature |
|---|---|---|
| Toner 1 | 175° C. | More than 230° C. |
| Toner 2 | 165° C. | More than 230° C. |
| Toner 3 | 180° C. | More than 230° C. |
| Toner 4 | 175° C. | More than 230° C. |
| Toner 5 | 165° C. | More than 230° C. |
| Toner 6 | 180° C. | More than 230° C. |
| Comparative toner 1 | 225° C. | 230° C. |
| Comparative toner 2 | 225° C. | 230° C. |

As apparent from the table, the toners according to the invention are high in fixing properties and low in environmental dependency.

What is claimed is:

1. A toner for electrostatic image developing, prepared by a process comprising the steps of:

suspending a mixture comprising a radically-polymerizable monomer, a low molecular weight polyolefin having a weight-average molecular weight of 6,000 to 70,000 and a number-average molecular weight of 1,500 to 20,000, a colorant and a radical polymerization initiator in a suspension medium;

suspension-polymerizing the suspended mixture to produce colored polymer particles having a volume-average particle size of 3 to 12 μm and containing the low molecular weight polyolefin; and applying a mechanical impact force to the colored polymer particles to produce treated particles having the low molecular weight polyolefin at the surface of the treated particles in an amount of 5 to 40 percent by number.

2. A toner as recited in claim 1, wherein the low molecular weight polyolefin is ethylene, propylene, butene-1, pentene-1, hexene-1, heptene-1, octene-1, nonene-1 or decene-1.

3. A toner as recited in claim 1, wherein the polymer particles contain a polymer produced by the suspension-polymerization, the polymer having a weight-average molecular weight of $5\times10^4$ to $1\times10^6$.

4. A toner as recited in claim 3, wherein the weight-average molecular weight of the polymer is $1\times10^3$ to $1\times10^5$.

5. A toner as recited in claim 1, wherein the polymer particles contain a polymer produced by the suspension-polymerization, the polymer having a softening point of 100° to 200° C. and a glass transition point of 50° to 70° C.

6. A toner as recited in claim 1, wherein the radically-polymerizable monomer is styrene, an olefin or α-methylene aliphatic monocarboxylate.

7. A toner as recited in claim 6, wherein the radically-polymerizable monomer is styrene or α-methylene aliphatic monocarboxylate.

8. A toner as recited in claim 6, wherein the radically-polymerizable monomer is styrene, o-methylstyrene, m-methylstyrene, p-methylstyrene, α-methylstyrene, p-ethylstyrene, 2,4-dimethylstyrene, p-butylstyrene, p-t-butylstyrene, p-hexylstyrene, p-octylstyrene, p-nonylstyrene, p-decylstyrene, p-dodecylstyrene, p-methoxystyrene, p-phenylstyrene, p-chlorostyrene or 3,4-dichlorostyrene.

9. A toner as recited in claim 6, wherein the radically-polymerizable monomer is ethyl acrylate, butyl acrylate, isobutyl acrylate, propyl acrylate, octyl acrylate, dodecyl acrylate, lauryl acrylate, 2-ethylhexyl acrylate, stearyl acrylate, 2-chloroethyl acrylate, phenylacrylate, methyl-α-chloroacrylate, methyl methacrylate, ethyl methacrylate, propyl methacrylate, butyl methacrylate, isobutyl methacrylate, octyl methacrylate, dodecyl methacrylate, lauryl methacrylate, 2-ethylhexyl methacrylate, stearyl methacrylate, phenyl methacrylate or diethylaminoethyl methacrylate.

10. A toner as recited in claim 6, wherein the suspension medium contains water.

11. A toner as recited in claim 10, wherein the suspension medium further contains a suspension stabilizer.

12. A toner as recited in claim 1, wherein the mechanical impact force is applied by means of a hybridizer.

13. A toner as recited in claim 1, wherein the treated particles have an average particle size of about 10 μm.

* * * * *